US006039922A

United States Patent [19]

Swank et al.

[11] Patent Number: 6,039,922

[45] Date of Patent: Mar. 21, 2000

[54] UV RADIATION AND VAPOR-PHASE HYDROGEN PEROXIDE STERILIZATION PACKAGING

[75] Inventors: Ronald Swank, Crystal Lake; Sevugan Palaniappan, Grayslake, both of Ill.

[73] Assignee: Tetra Laval Holdings & Finance, SA, Pully, Switzerland

[21] Appl. No.: 08/911,967

[22] Filed: Aug. 15, 1997

[51] Int. Cl.[7] ..... A61L 2/10; A61L 2/20; B65B 55/18; B65B 55/10

[52] U.S. Cl. ..... 422/24; 422/28; 422/304; 53/425

[58] Field of Search ..... 422/24, 28, 292, 422/302, 304; 53/425

[56] References Cited

U.S. PATENT DOCUMENTS

| | | | |
|---|---|---|---|
| 4,005,135 | 1/1977 | Helding . | |
| 4,037,112 | 7/1977 | Ramler et al. . | |
| 4,056,921 | 11/1977 | Gilliand et al. . | |
| 4,289,728 | 9/1981 | Peel et al. | 422/28 X |
| 4,366,125 | 12/1982 | Kodera et al. | 422/24 X |
| 4,375,145 | 3/1983 | Mosse et al. . | |
| 4,797,255 | 1/1989 | Hatanaka et al. . | |
| 4,944,132 | 7/1990 | Carlsson et al. . | |
| 4,992,247 | 2/1991 | Foti | 422/298 X |
| 5,069,017 | 12/1991 | Fabricius . | |
| 5,114,670 | 5/1992 | Duffey | 422/24 |
| 5,124,212 | 6/1992 | Lee et al. . | |
| 5,129,212 | 7/1992 | Duffey et al. . | |
| 5,178,841 | 1/1993 | Vokins et al. | 422/298 |
| 5,213,759 | 5/1993 | Castberg et al. . | |
| 5,326,542 | 7/1994 | Sizer et al. | 422/24 X |
| 5,364,645 | 11/1994 | Lagunas-Solar et al. . | |
| 5,368,828 | 11/1994 | Carlson . | |
| 5,433,920 | 7/1995 | Sizer et al. . | |
| 5,547,635 | 8/1996 | Duthie, Jr. | 422/24 |

*Primary Examiner*—Elizabeth McKane

[57] ABSTRACT

The present invention discloses a method and apparatus for sterilizing packaging with vapor-phase hydrogen peroxide and ultraviolet radiation on a packaging machine. A partially formed packaging material is sprayed with gaseous hydrogen peroxide thereby allowing the gas to condense on the packaging material. The packaging material is then conveyed to a UV radiation source for irradiation of the packaging material. The packaging material is then dried with heated air to flush/remove any residual hydrogen peroxide. The present invention sterilizes the packaging material allowing for filling of the packaging material with a desired product such as milk, juice or water. The packaging material may be any number of possibilities such as gable top cartons, parallelepiped containers, flexible pouches, and the like. The invention allows for the efficacious use of hydrogen peroxide having a concentration of up to 53% while providing a packaging material having less than 0.5 ppm hydrogen peroxide.

14 Claims, 7 Drawing Sheets

UV RADIATION AND VAPOR-PHASE HYDROGEN PEROXIDE STERILIZATION PACKAGING

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to sterilization of packaging. Specifically, the present invention relates to an apparatus and method for the sterilization of packaging using UV radiation and vapor-phase hydrogen peroxide.

2. Description of the Related Art

The present invention relates to an ultra-violet lamp assembly for use in irradiating packaging material in a form-fill-seal packaging machine. More particularly, the present invention relates to an ultra-violet lamp assembly for use in irradiating packaging material in a packaging machine wherein the ultra-violet lamp and its associated components are readily subject to cleaning or service.

Milk or juice is often packaged in cartons that have been sterilized to prolong shelf life of the contents under refrigeration. When milk or juice is being packaged under aseptic packaging conditions, the content are capable of being stored for a substantial period of time at room temperature without spoilage. Both of these packaging processes require effective sterilization of the packaging material prior to filling of a container formed from the packaging material. For example, a container, such as a gable-top container, that has previously been formed may have its interior surfaces sterilized prior to being filled with product. U.S. Pat. No. 4,375,145, discloses a packaging machine having a conveyor on which pre-formed cartons advance under ultraviolet germicidal solution, such as hydrogen peroxide, passing under the ultraviolet lamps.

U.S. Pat. No. 4,289,728, discloses a method for sterilization of the surfaces of food containers and other materials by applying a hydrogen peroxide solution, followed by ultraviolet radiation. This patent indicates that the peak intensity of ultraviolet radiation occurs at a wavelength of 254 nm. The concentration of the hydrogen peroxide solution is less than 10% by weight, and furthermore, the hydrogen peroxide solution is heated during or subsequent to irradiation.

UV sterilization has been shown to be suitable for sterilization of flat films but has been found to have limited applicability to preformed, angular containers (Maunder, 1977) due to the geometric and physical constraints associated with UV light. If a simple UV lamp is placed in close proximity above a preformed, such as a gable top carton, the sterilization effectiveness is severely limited due to several reasons. The total light flux entering the carton is restricted to light that can be directed through the carton opening, which in case of typical gable top cartons are 55×55 mm, 70×70 mm or 95×95 mm. Unreflected light emitted from a line source UV lamp decreases in intensity with the square distance from the light source. Thus, as the depth of the carton increases, the light intensity falls off.

Another problem in sterilizing these cartons with UV light is that the light enters the top of the carton and radiates toward the bottom substantially parallel to the sides of the carton. The germicidal effect of the light that impinges on the side is very low because of the high angle incidence. Thus, the sides of the cartons are the most difficult surfaces to sterilize, especially for tall cartons. When the cartons are positioned on the conveyor, two sides of the carton lie in a plane that is parallel to the axis of the lamp, while the other two sides are transverse to the axis of the lamp. Since the lamp is elongated, radiation impinges on the transverse sides of the carton at a higher angle of incidence than it does on parallel sides of the carton. In the case of a single UV lamp source above the center of a 70×70×250 mm rectangular carton, the effective light intensity at the bottom of the carton would be reduced to 13.9% of the maximum intensity at that distance from the source. The carton sides transverse to the lamp axis receive light from the entire length of the bulb. Light originating from the lamp reflector on the side opposite the parallel carton wall will have a minimum incident angle and thus have an intensity equal to 27.0% of the lamp intensity.

One ultraviolet lamp assembly that is designed to address, among other things, the problem of effective irradiation of pre- formed packages is disclosed in U.S. Pat. No. 5,433,920, to Sizer et al. In accordance with one aspect of the invention disclosed therein, an ultraviolet reflector for use with an ultraviolet lamp is utilized to effectively irradiate the sides as well as the bottom of the container.

A problem with current sterilization practices is the limitation of concentration of hydrogen peroxide which may be used on packaging material for food. Only a minute quantity of hydrogen peroxide residue may be found on the packaging which limits most applications to less than 1% concentration.

BRIEF SUMMARY OF THE INVENTION

On aspect of the present invention is a method for sterilization of packaging at a sterilization station on a form, fill and seal machine. The first step of the method is providing packaging to be sterilized at the sterilization station. The next step is subjecting the packaging to a predetermined quantity of vapor-phase hydrogen peroxide thereby creating a packaging coated with a thin layer of hydrogen peroxide. The next step is irradiating the coated packaging with ultraviolet radiation for a predetermined set of time thereby creating an irradiated packaging. The next step, and possibly final step is drying the irradiated packaging with heated air for a predetermined amount of time thereby creating a sterilized packaging having less than 0.5 parts per million residue of hydrogen peroxide.

Another aspect of the present invention is an apparatus for sterilizing packaging at a sterilization station on a form, fill and seal machine. The apparatus includes moving means, a sprayer, an ultraviolet radiation source and a heated air distributor. The moving means moves the packaging to the sterilization station. The sprayer subjects the packaging to a predetermined quantity of vapor-phase hydrogen peroxide thereby coating the packaging with a thin layer of hydrogen peroxide. The ultraviolet radiation source irradiates the coated packaging with ultraviolet radiation for a predetermined set of time and is downline from the sprayer. The heated air distributor flows hot air onto the packaging.

It is a primary object of the present invention to provide a method and apparatus for providing an extended shelf life packaging.

It is an additional object of the present invention to provide a method and apparatus for sterilizing packaging material on a form, fill and seal packaging machine using gaseous hydrogen peroxide and UV radiation.

It is yet an additional object of the present invention to provide a method and apparatus for sterilizing packaging material using hydrogen peroxide having a concentration upwards to 53%.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 schematic view of apparatus of the present invention integrated on linear form, fill and seal packaging machine;

Figure 2:
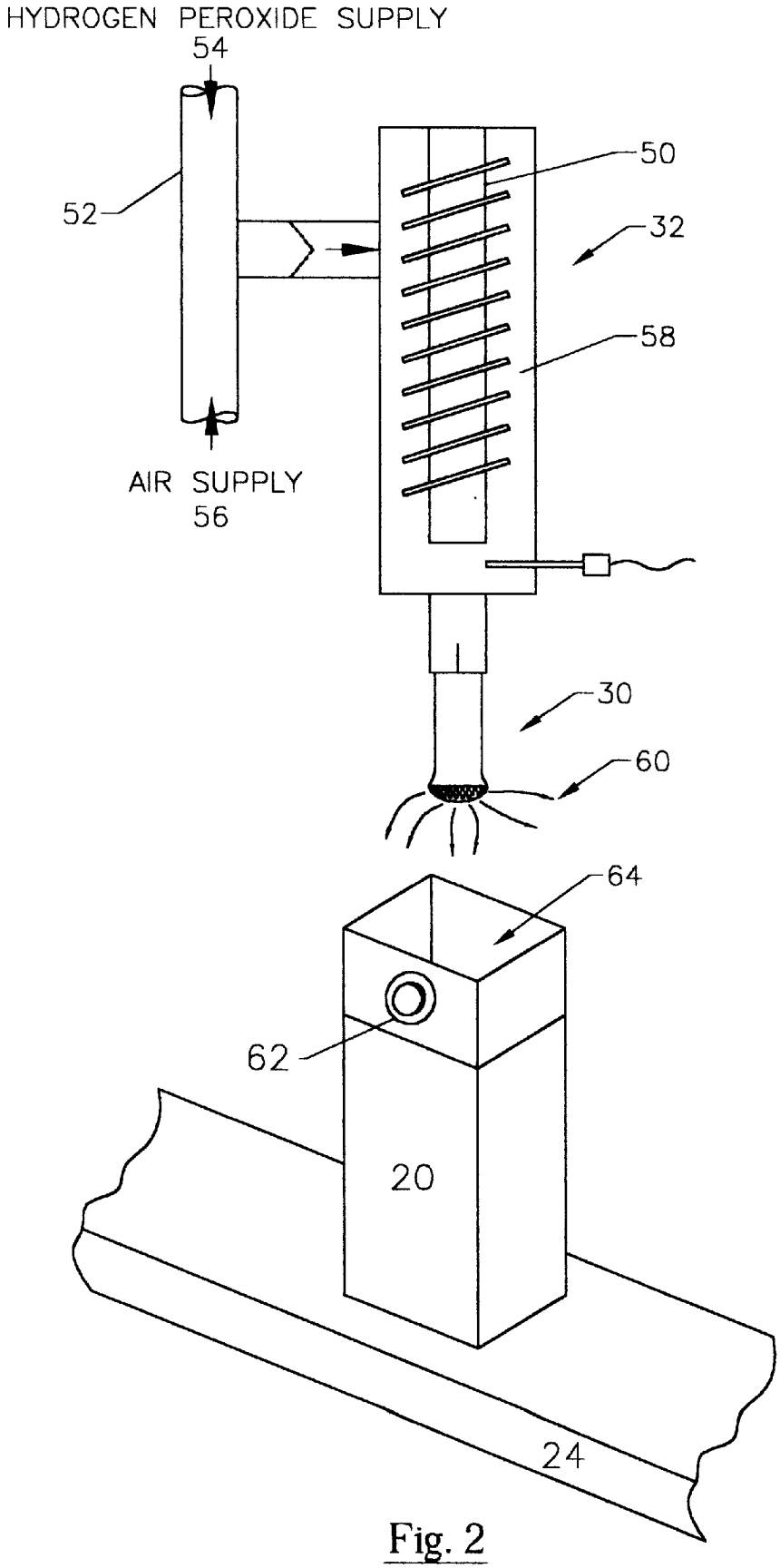
Figure 3:
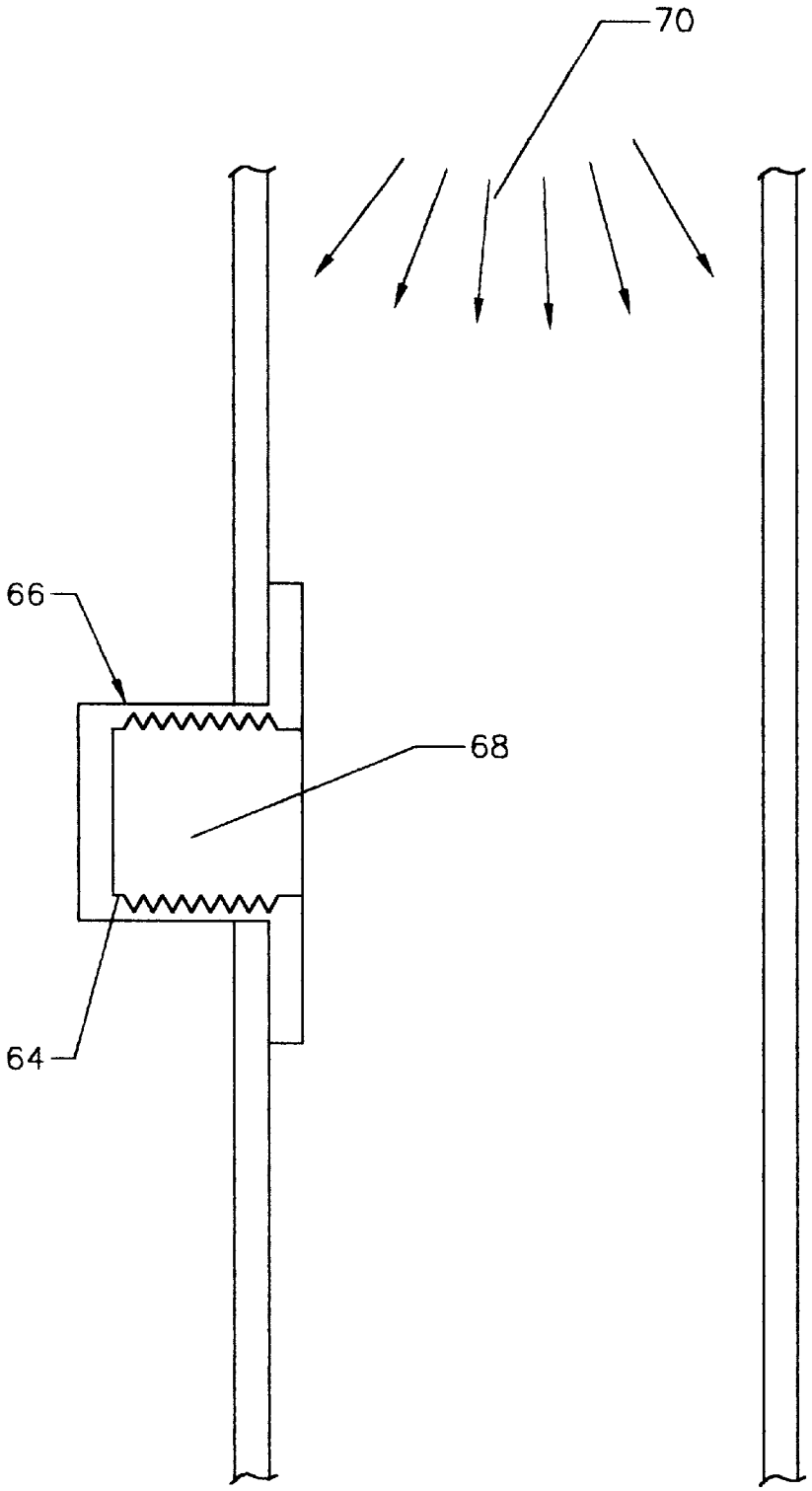
Figure 4:
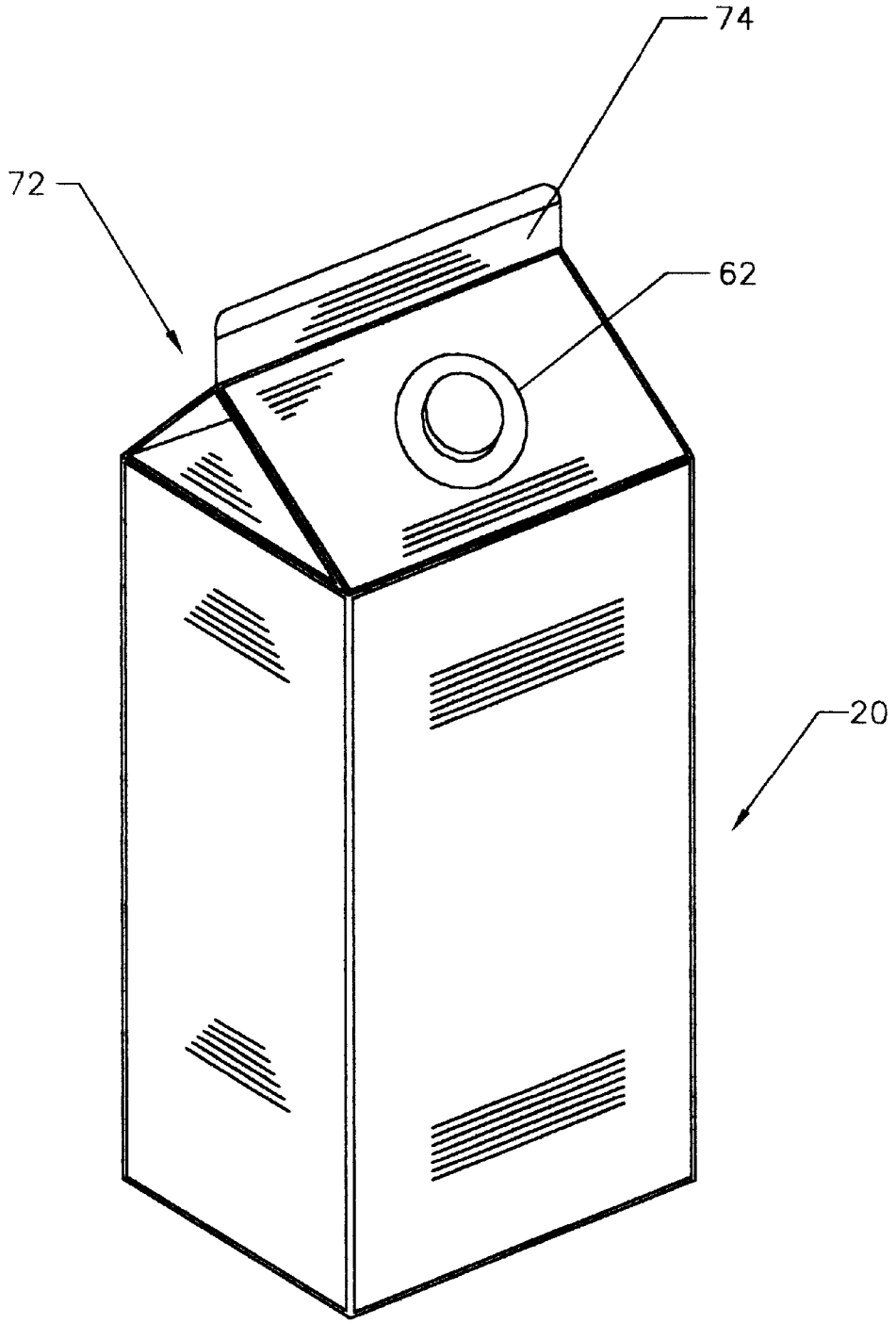
Figure 5:
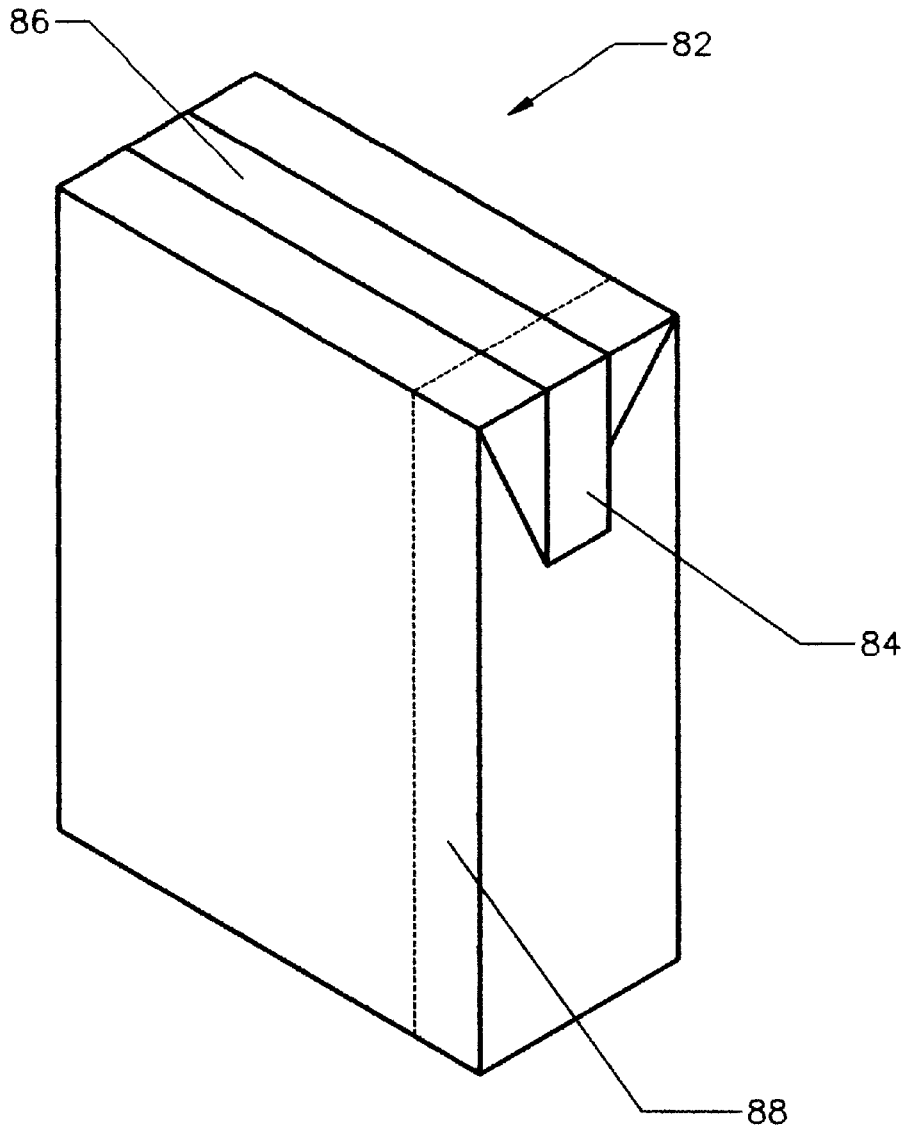
Figure 6:
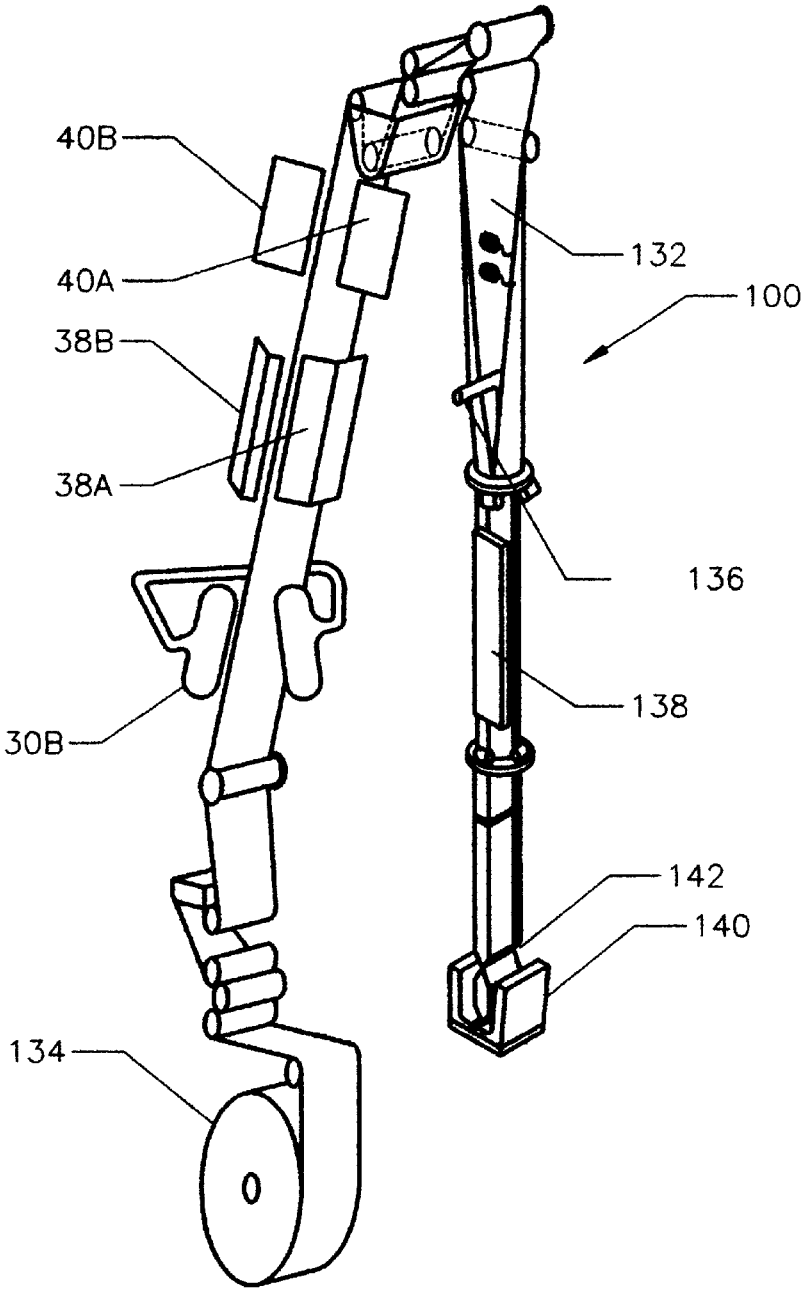
Figure 7:
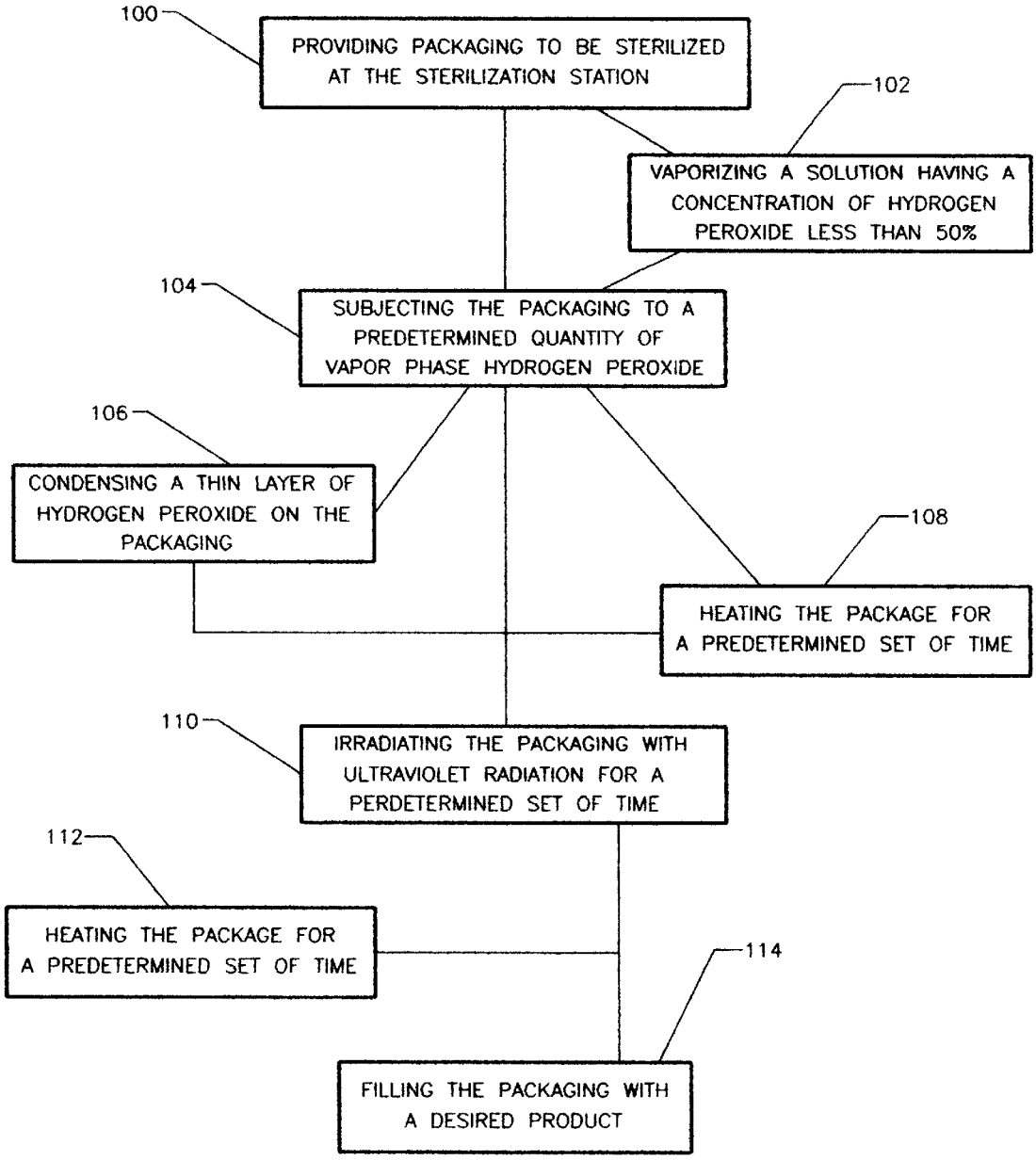

There is illustrated in FIG. 2 a schematic view of the vapor delivery system of the present invention;

There is illustrated in FIG. 3 a cross-sectional view of prior art sterilization using liquid hydrogen peroxide;

There is illustrated in FIG. 4 a perspective view of a carton capable of being sterilized by the present invention;

There is illustrated in FIG. 5 a perspective view of a parallelepiped container capable of being sterilized by the present invention;

There is illustrated in FIG. 6 schematic view of apparatus of the present invention integrated on vertical form, fill and seal packaging machine;

There is illustrated in FIG. 7 a flow diagram of the method of the present invention.

DETAILED DESCRIPTION OF THE INVENTION

The present invention applies to the sterilization of packaging materials, whether partially formed or not, undergoing fabrication to an aseptic container having an extended shelf life. Such an aseptic container may take the form of a fiberboard carton such as a TETRA REX® gable top carton, a parallelepiped container such as a TETRA BRIK® container, a flexible pouch such as a TETRA POUCH™, or the like. An application of the present invention is with containers fabricated along a horizontal conveyance system on a multiple station form, fill and seal packaging machine such as the TR/16 TETRA REX® packaging machine available from TETRA PAK®, Inc. of Chicago, Ill. Another application of the present invention is with the fabrication of a container on a vertical form, fill and seal machine which is utilized to manufacture parallelepiped containers and flexible pouches. An example of such a machine is the TETRA BRIK® Aseptic machine available from TETRA PAK®, Inc. of Chicago, Ill. Although application of the present invention has been described in reference to fabrication with the above-mentioned containers and on the above-mentioned machine, those skilled in the pertinent art will recognize that the application of the present invention with the fabrication of other containers are well within the scope of the present invention.

Carton Sterilization On A Multiple Station Packaging Machine

Figure 1:
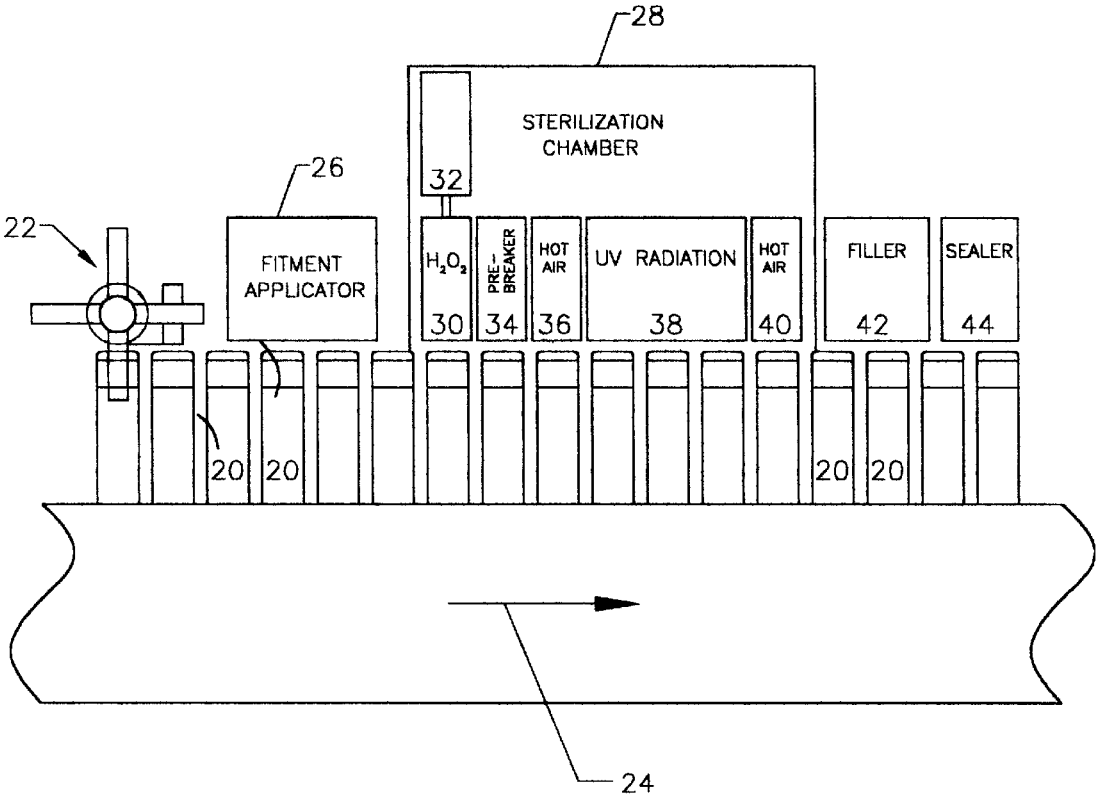

A common form of container for milk or juice is the gable top carton although some cartons no longer have a gable top. The carton has a paperboard substrate with a plastic (usually polyethylene) coating on the inside and the outside which enables the top of the carton to be closed and sealed after filling. Gable top cartons, standard or modified, are usually fabricated on a linear, multiple station, form, fill and seal packaging machine. An example of such a machine is the TR/16™ TETRA REX® packaging machine available from TETRA PAK, Inc. of Chicago, Ill. Referring to FIG. 1, the cartons 20 usually have a square bottom which is formed and heat sealed on a mandrel 22, and then placed on a conveyor 24 which advances at a predetermined interval (indexing) to the right as viewed in FIG. 1. The cartons 10 are placed equidistant apart and advance a predetermined number of carton positions during each periodic advancing step of the conveyor. Between each advancing step of the conveyor 24, the cartons 10 generally remain stationary for processing for the predetermined interval. The predetermined interval usually corresponds to the slowest process on the line in the fabrication of the carton. The slowest process is usually the sealing of the top of the carton after filling with a desired product. A carton 20 will wait for the predetermined interval, then proceed toward the next station.

As illustrated in FIG. 1, a series of cartons 20 are partially formed on a mandrel 22 on which an end of the carton, usually the bottom, is sealed thereby by providing a carton with sidewalls, a sealed bottom and an hollow interior. The cartons 20 then proceed to a fitment applicator station 26. Other machines may not have a fitment applicator, or may apply the fitment post-processing. In such situations, the cartons 20 proceed directly to the sterilization chamber 28. If a fitment is applied, various applicators may be employed. One such applicator is described in copending U.S. patent application Ser. No. 08/857,937 filed on May 16, 1997 for a Control System And Method For A Fitment Applicator Apparatus. Another such applicator is described in U.S. patent application Ser. No. 08/710,619 filed on Sep. 20, 1996 for a Process And Apparatus For Applying Fitments To A Carton. Both copending applications are hereby incorporated by reference.

Once conveyed inside the sterilization chamber 28, each of the series of cartons are subjected to vapor-phase hydrogen peroxide from an applicator 30. The applicator 30 may be a nozzle for dispensing the hydrogen peroxide gas onto the carton 20, and in a preferred embodiment is a continuous flowing applicator. The applicator 30 flows the gas over and around the carton during the predetermined interval. The hydrogen peroxide gas condenses on the carton 20 thereby coating the carton 20 with a thin layer of hydrogen peroxide. A vaporizer 32 is disposed above of the applicator 30. The vaporizer 32 transforms a solution of hydrogen peroxide into the vapor phase by heating the solution above the gas temperature of hydrogen peroxide, 175° C. The hydrogen peroxide applicator 30 and vaporizer 32 will be further described below. Next, a pre-breaker 34 for bending the carton 20 is optionally provided, however, a pre-breaker 34 is not necessary to practicing the present invention. Next, a hot air distributor 36 may optionally be provided for drying the coated carton 20 before entering the next substation. However, another embodiments may not have a hot air distributor 36, and such is not necessary for practicing the present invention.

Next, each of the cartons 20 is conveyed to the ultraviolet (UV) radiation chamber 38. The chamber 38 irradiates the coated carton 20 with UV radiation thereby providing a synergistic sterilization effect between UV radiation and hydrogen peroxide. As shown in FIG. 1, the UV chamber 38 is has a length of approximately three cartons 20 on the conveyor 24. Thus, as shown, the carton 20 is subjected to UV radiation for three predetermined intervals of time. The UV radiation may be UV-C, excimer UV light as described below, or the like. A possible UV chamber 38 is described in copending U.S. patent application Ser. No. 08/828,927 filed on May 16, 1997 for a Ultraviolet Assembly For Use In Irradiating Containers In A Packaging Machine, which is hereby incorporated by reference. A possible reflector for dispersing the UV radiation is described in U.S. Pat. No. 5,433,920 which is hereby incorporated by reference.

Next, each of the cartons 20 is conveyed to a hot air distributor 40 for drying the cartons 20 and for flushing/removing any hydrogen peroxide residue from the cartons 20. Again, this hot air distributor 40 is optional. Once the each of the cartons 20 exits the sterilization chamber 28, only 0.5 parts per million (ppm) should be present in the cartons 20. Each of the cartons 20 are next conveyed to a filling station 42 for filling the carton with a desired product such as milk or juice. Then to a heat sealing station 44 for sealing the end of the cartons 20, usually the top, which was not sealed previously thereby creating an extended shelf life product having a defect rate of less than 1 in a thousand. Defectives is measured by spoiled product.

FIG. 2 shows the vapor delivery system of the present invention. The vapor delivery system consists of the applicator 30 and the vaporizer 32. The vaporizer 32 may be a heat exchanger 50 which receives air and hydrogen peroxide through a conduit 52. The conduit is in flow communication with a hydrogen peroxide source 54 and an air supply 56. As the liquid solution of hydrogen peroxide enters the chamber 58 of the vaporizer 32, it is heated to a temperature in excess of 175° C., the vaporization temperature of hydrogen peroxide. In an alternative embodiment, the vaporizer may transform the solution of hydrogen peroxide into vapor through increasing the pressure instead of the temperature.

The vapor phase hydrogen peroxide flows through a second conduit 59 to the applicator 30 where it is sprayed onto a carton 20 as illustrated by arrows 60. The applicator may be a nozzle with a distribution of openings sufficient to widely disperse the gas. When the gas exits the applicator, its temperature has decreased to 80–90° C. The flow of hydrogen peroxide is continuous in a preferred embodiment, however, it is within the scope of the present invention to have intermittent spraying of the hydrogen peroxide gas.

The hydrogen peroxide gas enters and condenses on the opened interior 64 of the carton 20, the exposed exterior of the carton 20, and also condenses on the fitment 62. The condensation temperature for hydrogen peroxide is 60° C. As previously stated, the carton is stationary for the predetermined interval during which a predetermined amount of hydrogen peroxide gas condenses on the carton 20. For example, the predetermined interval may be 1.2 seconds.

Notable the present invention sterilizes the interior portion of the spout assemblies/fitment 64. In this respect, it is noted in FIG. 3 that each spout assembly may be functionally comprised of two sections: an exterior section 66, that, upon application to the respective carton 20 is disposed toward the exterior of the carton 20; and, an interior section 68 that, upon application to the respective carton 20 is disposed toward the interior of the carton 20. Generally, as illustrated in FIG. 3, sterilization of the interior sections of the spout assemblies/fitments 64 is neglected in that the interior sections 68 are difficult to access once the spout assemblies/fitments 64 have been attached to the respective carton 20. For example, a dispersion of liquid hydrogen peroxide, illustrated with arrows 70, fails to reach certain interior portions of the spout assembly/fitment 64. Such regions effectively become "shadowed" regions that do not receive an application of hydrogen peroxide. Accordingly, post-attachment container sterilization with liquid hydrogen peroxide frequently leaves substantial portions of the spout assembly in a septic state that may contaminate the contents of the carton, and thereby lowering its effective shelf life. By spraying gaseous hydrogen peroxide into and around the carton, such problems are reduced or eliminated.

There is shown in FIG. 4 a fully formed, sealed and filled gable top carton 20 fabricated using the present invention. The carton has the familiar gable top 72 which is accented by the top fin 74. The top fin is either heat sealed or ultrasonically sealed to prevent contamination of the carton 20 and the desired product contained therein. The fitment 62 is provided to access the contents of this carton 20, however, more traditional cartons would have an integrated pour spout accessed by tearing open a portion of the gable top 72.

Parallelepiped Container Fabrication

Fabrication of a parallelepiped container is similar to that of a gable top carton in that both are fabricated on a form, fill and seal machine, and both are composed of a fiberboard/paperboard material coated on both sides with a plastic such as polyethylene. However, parallelepiped containers are fabricated on a vertical form, fill and seal machine from a coiled web of packaging material whereas gable top cartons are formed from blanks fed into the machine. The epitome of parallelepiped containers is the TETRA BRIK® container which may be fabricated in a method disclosed in Niske, U.S. Pat. No. 4,848,063 for a Method Of Manufacturing Packaging Container which is hereby incorporated by reference in its entirety.

There is illustrated in FIG. 5 a parallelepiped container sterilized in accordance with the present invention. As shown in FIG. 5, the parallelepiped container is generally designated 82. The parallelepiped container 82 has a triangular flap forming panel 84, a transverse seal tab forming panel 86 and a longitudinal seal flap 88. In a preferred embodiment, the longitudinal seal creating the longitudinal seal flap 88 is made subsequent to sterilization with the present invention on a form, fill and seal machine. Subsequent to sterilization, the first transverse seal is made, the container 82 is filled, and a second transverse seal is made thereby creating the transverse seal tab forming panel 86. The container 82 is further manipulated to form the familiar parallelepiped shape.

There is illustrated in FIG. 6 a schematic view of an apparatus of the present invention integrated on a vertical form, fill and seal machine 100. A material 132, undergoing fabrication to a container shape and originating from a coil of material 134, is sprayed with gaseous hydrogen peroxide from a set of applicators 30A and 30B. The sprayers are of a predetermined length depending on the velocity of the machine 100. The gas should have a sufficient time to condense on the material 132 before proceeding to the UV radiation sources 38A and 38B. The vaporizer 32A, not shown, is in flow communication with both applicators 30A and 30B, however, each applicator may be provided with its own vaporizer 32A.

The coated material passes through a UV radiation sources 38A and 38B which irradiates the coated material 132 with sufficient radiation to fully sterilize the packaging material. A mercury lamp with a reflector as discussed above may be utilized as the UV radiation source. An excimer ultraviolet lamp composed of KrCl gas which emits a wavelength of 222 nm may also be utilized. Excimer lamps are more fully explained below. The material then proceeds to a set of hot air distributors/heaters 40A and 40B where the material is dried and any hydrogen peroxide residue is flushed/removed from the material providing a sterilized material 132 having less than 0.5 ppm. On the form, fill and seal machine 100 is a filling pipe 136 which provides for the flow of a desired contents into a partially formed container. The filling pipe 136 is attached to a source of the desired contents on one end, and open on the other end for distribution of the desired contents into a partially formed container. Downstream from the filling pipe 136 is a longitudinal sealer 138. The longitudinal sealer 138 seals the material 132 longitudinally thereby forming an enclosed tubular material. Subsequent to the sealer 138 is the transverse sealer 140 which seals the material transversally prior to filling with a desired contents. At the same time the bottom of one container is being sealed, the top of another container is being sealed. The filled and sealed containers are cut from the rest of the material 132 by a cutting jaw 142. Subsequent to the cutting jaw 142, the newly formed container 144 may be further manipulated into a parallelepiped container.

In an alternative embodiment, a second set of heated air distributors, not shown, may be placed prior to the ultraviolet radiation sources. In this manner, the coated packaging material 132 is dried prior to irradiation.

Excimer Ultraviolet Technology

The present invention may utilize excimer ultraviolet technology as the ultraviolet radiation source. Excimers are evanescent, electronically excited molecular complexes which exist only under unique conditions. The excimer is in an excited state as opposed to a ground state. In this excited state, elements such as the noble gases which are normally unreactive, are able to bind to one another or to other elements. Excimers usually disintegrate within a microsecond of formation and emit their binding energy as a photon as the two elements return to the ground state. For ultraviolet applications, the excimers formed from noble gas atoms or excimers formed from a noble gas and a halogen are of particular importance. Some of the more well known ultraviolet excimers include $Ar_2$, $Kr_2$, $Xe_2$, ArCl, KrCl, KrF and XeCl. These molecular complexes are ultraviolet excimers because the disintegration of the excimer, excited dimer, results in an emission in the ultraviolet range of the electromagnetic spectrum. For example, the emission from KrCl has a wavelength of 222 nanometers ("nm"), the emission from KrF has a wavelength of 248 nanometers, the emission from $Xe_2$ has a wavelength of 172 nm, and the emission from XeCl has a wavelength of 308 nm. Although several ultraviolet excimers have been mentioned in reference to the present invention, those skilled in the pertinent art will recognize that other ultraviolet excimers may be employed in practicing the present invention without departing from the scope of the present invention.

An example of the excimer process for xenon is as follows. First, a xenon atom in the ground state is excited by interaction with an electron to an excited state. Next, this excited xenon atom reacts with a ground state xenon atom to form an excimer complex. Within a microsecond after formation, the xenon atoms dissociate to two ground state xenon atoms and doing so emit an ultraviolet photon.

The present invention may involve an excimer ultraviolet lamp in which a gas capable of forming excimers is hermetically sealed within a quartz glass shell. The gas may be a noble gas or a mixture of noble gas and a halogen. Electrons are generated by electrodes located outside of the shell and separated by a discharge gap. In a preferred embodiment, the excimer ultraviolet lamp is cylindrical in shape having an aperture therethrough the center. In this embodiment, one electrode is juxtaposed to the exterior surface of the ultraviolet lamp while the second electrode is juxtaposed on the interior surface of the cylinder of the ultraviolet lamp. It should be noted that UV radiation is used synonymously with UV energy, since the amount of UV radiation is determined in watts or joules.

There is illustrated in FIG. 7 a flow diagram of the method of the present invention. At step 200, a packaging material is provided, either a partially formed gable top carton 20, a web of packaging material 132, or the like. At step 202, the hydrogen peroxide is vaporized by a vaporizer 32. At step 204, the packaging material is subjected to a predetermined quantity of gaseous hydrogen peroxide. At step 206, the gas condenses on the packaging material forming a thin layer of hydrogen peroxide. At step 208, the coated packaging material may be optionally dried/heated. At step 210, the packaging material is irradiated with UV radiation, UV-C, excimer, or the like. The irradiation is sufficient to sterilize the material. At step 212, the packaging material may optionally be heated in order to dry the material and to flush/remove any residue of hydrogen peroxide. The material should have less than 0.5 ppm of hydrogen peroxide. At step 214, the sterilized packaging material is filled and then sealed.

The present invention will be described in the following examples which will further demonstrated the efficacy of the novel sterilization method and apparatus, however, the scope of the present invention is not to be limited by these examples.

TR/16 UV-H2O2 Vapor Test w/Cartons Inoculated with BSA Spores

Purpose

The purpose for this series of runs was to start developing the optimum conditions for running vapor H2O2 in place of liquid H2O2 using cartons inoculated with *Bacillus subtilis* A spores to determine kill levels.

Procedure

The test run was performed on 8-1-97 at the Tetra Pak Research Center in Buffalo Grove, Ill. For this study 2 liter cartons without screw-caps were inoculated with *Bacillus subtilus* A Spores using the "swab on/swab off" method. The inoculum, a refrigerated 10 7.5 *Bacillus subtilis* A Spore suspension, was applied at a volume of 10 $\mu$l to the center of a marked 50 cm2 area on the lower portion of panel 4. A sterile cotton swab was moistened in sterile phosphate buffer and twisted against the side of the test tube to remove the excess liquid. The swab was used to spread the 10 $\mu$l of spores as uniformly as possible over the 50 cm2 area. All cartons, including the uninoculated negative controls, were allowed to dry of 1 hour under the hood. The variables listed in Tables 1 and 2 were ran and plated on Standard Methods Agar and incubated at 30° C. for 48 hours. The results are presented in Tables 1 and 2.

Fixed Parameters:

Hot Air

Condition #15=Air Flow: 30 m/s Temp: 440° C.

Condition #21=Air Flow: 13.8 m/s Temp: 373° C.

Summary of Results

TABLE 1

| Sample ID | Variables | # of Cartons | Average Log Reduction | Standard Deviation |
|---|---|---|---|---|
| PC | Positive Controls—No UV, No H2O2, No Hot Air | 10 | 4.56* | 0.15 |
| A | 35% H2O2, No UV, Hot Air After — Condition #15 | 10 | 3.95 | 0.48 |
| B | 35% H2O2, UV, Hot Air After — Condition #15 | 10 | 4.56 | 0.0 |
| C | 35% H2O2, UV, Hot Air Before — Condition #21 | 10 | 4.56 | 0.0 |
| D | 15% H2O2, UV, Hot Air Before — Condition #21 | 10 | 4.56 | 0.0 |

*Log Average

TABLE 2

| Sample ID | Variables | # of Cartons | Average Log Reduction | Standard Deviation |
|---|---|---|---|---|
| PC | Positive Controls—No UV, No H2O2, No Hot Air | 10 | 4.56* | 0.15 |
| A | 0.5% H2O2, UV L-6, Hot Air After | 10 | 4.54 | 0.06 |
| B | 2.0% H2O2, UV L-6, Hot Air After | 10 | 4.56 | 0 |
| C | 2.0% H2O2, UV L-8, Hot Air After | 10 | 4.56 | 0 |
| D | 35% H2O2, No UV, Hot Air After — Condition #15 | 10 | 4.45 | 0.09 |
| E | 35% H2O2, UV L-6, Hot Air After — Condition #21 | 10 | 4.56 | 0.0 |
| F | 2% H2O2, UV L-6, Hot Air Before — Condition #21 | 10 | 4.56 | 0.0 |

*Log Average

TABLE THREE

| Sample ID | Description | Result 1 | Result 2 | CFU/50 sq.cm | Log | Log Reduction |
|---|---|---|---|---|---|---|
| | | 8/1/97 Project 101 | | | | |
| | TR/16 Test: H2O2 Vapor w/ Cartons Inoculated with BSA Spores | | | | | |
| | Positive Controls | | | | | |
| PC1 | Positive Control BSA Spore Application | 49000 | 41000 | 135000 | 5.130333768 | |
| PC2 | Positive Control BSA Spore Application | 51000 | 53000 | 156000 | 5.193124598 | |
| PC3 | Positive Control BSA Spore Application | 31000 | 43000 | 111000 | 5.045322979 | |
| PC4 | Positive Control BSA Spore Application | 24000 | 24000 | 72000 | 4.857332496 | |
| PC5 | Positive Control BSA Spore Application | 36000 | 53000 | 133500 | 5.125481266 | |
| PC6 | Positive Control BSA Spore Application | 30000 | 27000 | 85500 | 4.931966115 | |
| PC7 | Positive Control BSA Spore Application | 17000 | 19000 | 54000 | 4.73239376 | |
| PC8 | Positive Control BSA Spore Application | 20000 | 23000 | 64500 | 4.809559715 | |
| PC9 | Positive Control BSA Spore Application | 29000 | 23000 | 78000 | 4.892094603 | |
| PC10 | Positive Control BSA Spore Application | 29100 | 24000 | 79650 | 4.90118578 | |
| | | | | Average | 4.560814502 | |
| | | | | Std. Deviation | 0.153414129 | |
| A1 | 35% H2O2, No UV Hot Air After Cond. #15 | 3 | 0 | 4.5 | 0.653212514 | 3.907601988 |
| A2 | 35% H2O2, No UV Hot Air After Cond. #15 | 17 | 1 | 27 | 1.431363764 | 3.129450738 |
| A3 | 35% H2O2, No UV Hot Air After Cond. #15 | 0 | 0 | 0 | | 4.560814502 |
| A4 | 35% H2O2, No UV Hot Air After Cond. #15 | 0 | 0 | 0 | | 4.560814502 |
| A5 | 35% H2O2, No UV Hot Air After Cond. #15 | 5 | 3 | 12 | 1.079181246 | 3.481633256 |
| A6 | 35% H2O2, No UV Hot Air After Cond. #15 | 1 | 0 | 1.5 | 0.176091259 | 4.384723243 |
| A7 | 35% H2O2, No UV Hot Air After Cond. #15 | 5 | 0 | 7.5 | 0.875061263 | 3.685753239 |
| A8 | 35% H2O2, No UV Hot Air After Cond. #15 | 1 | 1 | 3 | 0.477121255 | 4.083693247 |
| A9 | 35% H2O2, No UV Hot Air After Cond. #15 | 1 | 1 | 3 | 0.477121255 | 4.083693247 |
| A10 | 35% H2O2, No UV Hot Air After Cond. #15 | 5 | 1 | 9 | 0.954242509 | 3.606571992 |
| | | | | | Average | 3.948474995 |
| | | | | | Std Dev | 0.477625232 |
| B1 | 35% H2O2, UV, Hot Air After Cond. #15 | 0 | 0 | 0 | | 4.560814502 |
| B2 | 35% H2O2, UV, Hot Air After Cond. #15 | 0 | 0 | 0 | | 4.560814502 |
| B3 | 35% H2O2, UV, Hot Air After Cond. #15 | 0 | 0 | 0 | | 4.560814502 |
| B4 | 35% H2O2, UV, Hot Air After Cond. #15 | 0 | 0 | 0 | | 4.560814502 |
| B5 | 35% H2O2, UV, Hot Air After Cond. #15 | 0 | 0 | 0 | | 4.560814502 |
| B6 | 35% H2O2, UV, Hot Air After Cond. #15 | 0 | 0 | 0 | | 4.560814502 |
| B7 | 35% H2O2, UV, Hot Air After Cond. #15 | 0 | 0 | 0 | | 4.560814502 |
| B8 | 35% H2O2, UV, Hot Air After Cond. #15 | 0 | 0 | 0 | | 4.560814502 |
| B9 | 35% H2O2, UV, Hot Air After Cond. #15 | 0 | 0 | 0 | | 4.560814502 |
| B10 | 35% H2O2, UV, Hot Air After Cond. #15 | 0 | 0 | 0 | | 4.560814502 |
| C1 | 35% H2O2, UV, Hot Air Before Cond. #21 | 0 | 0 | 0 | | 4.560814502 |
| C2 | 35% H2O2, UV, Hot Air Before Cond. #21 | 0 | 0 | 0 | | 4.560814502 |
| C3 | 35% H2O2, UV, Hot Air Before Cond. #21 | 0 | 0 | 0 | | 4.560814502 |
| C4 | 35% H2O2, UV, Hot Air Before Cond. #21 | 0 | 0 | 0 | | 4.560814502 |
| C5 | 35% H2O2, UV, Hot Air Before Cond. #21 | 0 | 0 | 0 | | 4.560814502 |

TABLE THREE-continued

8/1/97
Project 101

| Sample ID | Description | Result 1 | Result 2 | CFU/50 sq.cm | Log | Log Reduction |
|---|---|---|---|---|---|---|
| C6 | 35% H2O2, UV, Hot Air Before Cond. #21 | 0 | 0 | 0 | | 4.560814502 |
| C7 | 35% H2O2, UV, Hot Air Before Cond. #21 | 0 | 0 | 0 | | 4.560814502 |
| C8 | 35% H2O2, UV, Hot Air Before Cond. #21 | 0 | 0 | 0 | | 4.560814502 |
| C9 | 35% H2O2, UV, Hot Air Before Cond. #21 | 0 | 0 | 0 | | 4.560814502 |
| C10 | 35% H2O2, UV, Hot Air Before Cond. #21 | 0 | 0 | 0 | | 4.560814502 |
| D1 | 15% H2O2, UV, Hot Air Before Cond. #21 | 0 | 0 | 0 | | 4.560814502 |
| D2 | 15% H2O2, UV, Hot Air Before Cond. #21 | 0 | 0 | 0 | | 4.560814502 |
| D3 | 15% H2O2, UV, Hot Air Before Cond. #21 | 0 | 0 | 0 | | 4.560814502 |
| D4 | 15% H2O2, UV, Hot Air Before Cond. #21 | 0 | 0 | 0 | | 4.560814502 |
| D5 | 15% H2O2, UV, Hot Air Before Cond. #21 | 0 | 0 | 0 | | 4.560814502 |
| D6 | 15% H2O2, UV, Hot Air Before Cond. #21 | 0 | 0 | 0 | | 4.560814502 |
| D7 | 15% H2O2, UV, Hot Air Before Cond. #21 | 0 | 0 | 0 | | 4.560814502 |
| D8 | 15% H2O2, UV, Hot Air Before Cond. #21 | 0 | 0 | 0 | | 4.560814502 |
| D9 | 15% H2O2, UV, Hot Air Before Cond. #21 | 0 | 0 | 0 | | 4.560814502 |
| D10 | 15% H2O2, UV, Hot Air Before Cond. #21 | 0 | 0 | 0 | | 4.560814502 |
| | Positive Control Cartons Sprayed w/ BSA Spores — Batch #1 from Sweden | | | | | |
| IC1 | Inoculated Control-SC-2 Log | 0 | 0 | | | |
| IC2 | Inoculated Control-SC-2 Log | 0 | 0 | | | |
| IC3 | Inoculated Control-SC-2 Log | 0 | 0 | | | |
| IC4 | Inoculated Control-SC-2 Log | 0 | 0 | | | |
| IC5 | Inoculated Control-NSC-2 Log | 0 | 0 | | | |
| IC6 | Inoculated Control-NSC-2 Log | 1 | 0 | | | |
| IC7 | Inoculated Control-SC-3 Log | 0 | 0 | | | |
| IC8 | Inoculated Control-SC-3 Log | 0 | 0 | | | |
| IC9 | Inoculated Control-SC-3 Log | 0 | 0 | | | |
| IC10 | Inoculated Control-SC-3 Log | 0 | 0 | | | |
| IC11 | Inoculated Control-NSC-3 Log | 0 | 0 | | | |
| IC12 | Inoculated Control-NSC-3 Log | 0 | 0 | | | |
| IC13 | Inoculated Control-SC-4 Log | 1 | 0 | | | |
| IC14 | Inoculated Control-SC-4 Log | 0 | 0 | | | |
| IC15 | Inoculated Control-SC-4 Log | 0 | 0 | | | |
| IC16 | Inoculated Control-SC-4 Log | 0 | 0 | | | |
| IC17 | Inoculated Control-NSC-4 Log | 1 | 0 | | | |
| IC18 | Inoculated Control-NSC-4 Log | 0 | 0 | | | |

TABLE FOUR

8/8/97
Project 104
TR/16 Test Results: H2O2 Vapor w/ Spore Inoculated Cartons

| Sample ID | Description | Result 1 | Result 2 | CFU/20 sq.cm | Log | Log Reduction |
|---|---|---|---|---|---|---|
| | | Positive Controls | | | | |
| PC1 | Positive Control BSA Spore Application | 47000 | 53000 | 150000 | 5.176091259 | |
| PC2 | Positive Control BSA Spore Application | 30000 | 35000 | 97500 | 4.989004616 | |
| PC3 | Positive Control BSA Spore Application | 28000 | 32000 | 90000 | 4.954242509 | |
| PC4 | Positive Control BSA Spore Application | 34000 | 37000 | 106500 | 5.027349608 | |
| PC5 | Positive Control BSA Spore Application | 21500 | 24600 | 69150 | 4.839792184 | |
| PC6 | Positive Control BSA Spore Application | 15700 | 14100 | 44700 | 4.650307523 | |
| PC7 | Positive Control BSA Spore Application | 36000 | 39000 | 112500 | 5.051152522 | |
| PC8 | Positive Control BSA Spore Application | 42000 | 44000 | 129000 | 5.11058971 | |
| PC9 | Positive Control BSA Spore Application | 41000 | 30000 | 106500 | 5.027349608 | |
| PC10 | Positive Control BSA Spore Application | 31000 | 38000 | 103500 | 5.01494035 | |
| | | | | Average | 4.560814502 | |
| | | | | Std. Deviation | 0.147273819 | |
| A1 | 0.5% H2O2, UV L-6, Hot Air After | 0 | 0 | 0 | | 4.560814502 |
| A2 | 0.5% H2O2, UV L-6, Hot Air After | 0 | 1 | 1.5 | 0.176091259 | 4.384723243 |
| A3 | 0.5% H2O2, UV L-6, Hot Air After | 0 | 0 | 0 | | 4.560814502 |
| A4 | 0.5% H2O2, UV L-6, Hot Air After | 0 | 0 | 0 | | 4.560814502 |
| A5 | 0.5% H2O2, UV L-6, Hot Air After | 0 | 0 | 0 | | 4.560814502 |
| A6 | 0.5% H2O2, UV L-6, Hot Air After | 0 | 0 | 0 | | 4.560814502 |
| A7 | 0.5% H2O2, UV L-6, Hot Air After | 0 | 0 | 0 | | 4.560814502 |
| A8 | 0.5% H2O2, UV L-6, Hot Air After | 0 | 0 | 0 | | 4.560814502 |
| A9 | 0.5% H2O2, UV L-6, Hot Air After | 0 | 0 | 0 | | 4.560814502 |
| A10 | 0.5% H2O2, UV L-6, Hot Air After | 0 | 0 | 0 | | 4.560814502 |
| | | | | | Average | 4.543205376 |

TABLE FOUR-continued

8/8/97
Project 104
TR/16 Test Results: H2O2 Vapor w/ Spore Inoculated Cartons

| Sample ID | Description | Result 1 | Result 2 | CFU/20 sq.cm | Log | Log Reduction |
|---|---|---|---|---|---|---|
| | | | | | Std Dev | 0.055684945 |
| B1 | 2.0% H2O2, UV L-6, Hot Air After | 0 | 0 | 0 | | 4.560814502 |
| B2 | 2.0% H2O2, UV L-6, Hot Air After | 0 | 0 | 0 | | 4.560814502 |
| B3 | 2.0% H2O2, UV L-6, Hot Air After | 0 | 0 | 0 | | 4.560814502 |
| B4 | 2.0% H2O2, UV L-6, Hot Air After | 0 | 0 | 0 | | 4.560814502 |
| B5 | 2.0% H2O2, UV L-6, Hot Air After | 0 | 0 | 0 | | 4.560814502 |
| B6 | 2.0% H2O2, UV L-6, Hot Air After | 0 | 0 | 0 | | 4.560814502 |
| B7 | 2.0% H2O2, UV L-6, Hot Air After | 0 | 0 | 0 | | 4.560814502 |
| B8 | 2.0% H2O2, UV L-6, Hot Air After | 0 | 0 | 0 | | 4.560814502 |
| B9 | 2.0% H2O2, UV L-6, Hot Air After | 0 | 0 | 0 | | 4.560814502 |
| B10 | 2.0% H2O2, UV L-6, Hot Air After | 0 | 0 | 0 | | 4.560814502 |
| | | | | | Average | 4.560814502 |
| | | | | | Std Dev | 0 |
| C1 | 2.0% H2O2, UV L-8, Hot Air After | 0 | 0 | 0 | | 4.560814502 |
| C2 | 2.0% H2O2, UV L-8, Hot Air After | 0 | 0 | 0 | | 4.560814502 |
| C3 | 2.0% H2O2, UV L-8, Hot Air After | 0 | 0 | 0 | | 4.560814502 |
| C4 | 2.0% H2O2, UV L-8, Hot Air After | 0 | 0 | 0 | | 4.560814502 |
| C5 | 2.0% H2O2, UV L-8, Hot Air After | 0 | 0 | 0 | | 4.560814502 |
| C6 | 2.0% H2O2, UV L-8, Hot Air After | 0 | 0 | 0 | | 4.560814502 |
| C7 | 2.0% H2O2, UV L-8, Hot Air After | 0 | 0 | 0 | | 4.560814502 |
| C8 | 2.0% H2O2, UV L-8, Hot Air After | 0 | 0 | 0 | | 4.560814502 |
| C9 | 2.0% H2O2, UV L-8, Hot Air After | 0 | 0 | 0 | | 4.560814502 |
| C10 | 2.0% H2O2, UV L-8, Hot Air After | 0 | 0 | 0 | | 4.560814502 |
| | | | | | Average | 4.560814502 |
| | | | | | Std Dev | 0 |
| D1 | 35% H2O2, No UV, Hot Air After | 1 | 0 | 1.5 | 0.176091259 | 4.384723243 |
| D2 | 35% H2O2, No UV, Hot Air After | 0 | 1 | 1.5 | 0.176091259 | 4.384723243 |
| D3 | 35% H2O2, No UV, Hot Air After | 0 | 1 | 1.5 | 0.176091259 | 4.384723243 |
| D4 | 35% H2O2, No UV, Hot Air After | 0 | 0 | 0 | | 4.560814502 |
| D5 | 35% H2O2, No UV, Hot Air After | 0 | 0 | 0 | | 4.560814502 |
| D6 | 35% H2O2, No UV, Hot Air After | 0 | 0 | 0 | | 4.560814502 |
| D7 | 35% H2O2, No UV, Hot Air After | 0 | 1 | 1.5 | 0.176091259 | 4.384723243 |
| D8 | 35% H2O2, No UV, Hot Air After | 0 | 0 | 0 | | 4.560814502 |
| D9 | 35% H2O2, No UV, Hot Air After | 1 | 0 | 1.5 | 0.176091259 | 4.384723243 |
| D10 | 35% H2O2, No UV, Hot Air After | 0 | 1 | 1.5 | 0.176091259 | 4.384723243 |
| | | | | | Average | 4.455159746 |
| | | | | | Std Dev | 0.090933135 |
| E1 | 35% H2O2, UV L-6, Hot Air After | 0 | 0 | 0 | | 4.560814502 |
| E2 | 35% H2O2, UV L-6, Hot Air After | 0 | 0 | 0 | | 4.560814502 |
| E3 | 35% H2O2, UV L-6, Hot Air After | 0 | 0 | 0 | | 4.560814502 |
| E4 | 35% H2O2, UV L-6, Hot Air After | 0 | 0 | 0 | | 4.560814502 |
| E5 | 35% H2O2, UV L-6, Hot Air After | 0 | 0 | 0 | | 4.560814502 |
| E6 | 35% H2O2, UV L-6, Hot Air After | 0 | 0 | 0 | | 4.560814502 |
| E7 | 35% H2O2, UV L-6, Hot Air After | 0 | 0 | 0 | | 4.560814502 |
| E8 | 35% H2O2, UV L-6, Hot Air After | 0 | 0 | 0 | | 4.560814502 |
| E9 | 35% H2O2, UV L-6, Hot Air After | 0 | 0 | 0 | | 4.560814502 |
| E10 | 35% H2O2, UV L-6, Hot Air After | 0 | 0 | 0 | | 4.560814502 |
| | | | | | Average | 4.560814502 |
| | | | | | Std Dev | 0 |
| F1 | 2.0% H2O2, UV L-6, Hot Air Before | 0 | 0 | 0 | | 4.560814502 |
| F2 | 2.0% H2O2, UV L-6, Hot Air Before | 0 | 0 | 0 | | 4.560814502 |
| F3 | 2.0% H2O2, UV L-6, Hot Air Before | 0 | 0 | 0 | | 4.560814502 |
| F4 | 2.0% H2O2, UV L-6, Hot Air Before | 0 | 0 | 0 | | 4.560814502 |
| F5 | 2.0% H2O2, UV L-6, Hot Air Before | 0 | 0 | 0 | | 4.560814502 |
| F6 | 2.0% H2O2, UV L-6, Hot Air Before | 0 | 0 | 0 | | 4.560814502 |
| F7 | 2.0% H2O2, UV L-6, Hot Air Before | 0 | 0 | 0 | | 4.560814502 |
| F8 | 2.0% H2O2, UV L-6, Hot Air Before | 0 | 0 | 0 | | 4.560814502 |
| F9 | 2.0% H2O2, UV L-6, Hot Air Before | 0 | 0 | 0 | | 4.560814502 |
| F10 | 2.0% H2O2, UV L-6, Hot Air Before | 0 | 0 | 0 | | 4.560814502 |
| | | | | | Average | 4.560814502 |
| | | | | | Std Dev | 0 |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A method for sterilizing a series of cartons being processed on a multiple station form, fill and seal packaging machine, each of the cartons erected and having sidewalls defining a hollow interior, the method comprising:

forming the bottom of each of the erected cartons on a mandrel to create a series of partially formed cartons;

placing each of the partially formed cartons on a conveyor assembly;

moving each of the partially formed cartons along the conveyor assembly at a predetermined interval to a vapor nozzle disposed above a partially formed carton on the conveyor assembly;

transforming a 35% concentration of hydrogen peroxide into a vapor phase hydrogen peroxide at a vaporizer, the vaporizer disposed above and in flow communication with the vapor nozzle;

applying a predetermined quantity of vapor-phase hydrogen peroxide for the predetermined interval to the interior and the exposed exterior of each of the partially formed cartons positioned at the vapor nozzle, the vapor-phase hydrogen peroxide applied through the vapor nozzle disposed approximately above the center of each of the partially formed cartons;

condensing the vapor-phase hydrogen peroxide onto each of the partially-formed cartons;

flowing hot air into each of the partially-formed cartons for the predetermined interval to remove hydrogen peroxide at a first hot air distribution station;

irradiating each of the partially formed cartons with ultraviolet radiation from a ultraviolet radiation source for a multiple of the predetermined interval, the ultraviolet radiation source disposed above the conveyor assembly and having a reflector to widely disperse the ultraviolet radiation to provide irradiation of the interior and the exposed exterior of each of the partially formed cartons; and flowing hot air into each of the partially formed cartons for the predetermined interval at a second hot air distribution station to remove substantially all of the hydrogen peroxide;

whereby each of the partially formed cartons are sterilized and have a residue less than 0.5 parts per million of hydrogen peroxide while having a 4.5 log reduction of microogranisms.

2. The method according to claim 1 further comprising the step of filling each of the partially formed cartons.

3. The method according to claim 1 wherein each of the partially formed cartons has a fitment disposed thereon whereby the exposed portions of the fitment are sterilized with the sterilization of each of the partially formed cartons.

4. The method according to claim 1 wherein the vapor-phase hydrogen peroxide has a concentration lower than 53%.

5. The method according to claim 1 wherein the vapor-phase hydrogen peroxide has a concentration of 35%.

6. The method according to claim 1 wherein the ultraviolet radiation is provided by an excimer ultraviolet lamp have a substantially monochromatic wavelength.

7. The method according to claim 1 further comprising the step of transforming to the vapor phase a solution of hydrogen peroxide having a concentration less than 53% prior to the step of subjecting each of the partially formed cartons to a predetermined quantity of vapor-phase hydrogen peroxide.

8. The method according to claim 1 wherein the method for sterilizing occurs within a station substantially enclosed within the packaging machine.

9. A packaging machine for processing a series of cartons, each of the cartons erected and having sidewalls defining a hollow interior, the packaging machine comprising:

a bottom forming station for forming the bottom of each of the erected cartons to create the partially formed cartons;

a conveyor assembly for moving each of the partially formed cartons from the bottom forming station at a predetermined interval;

a vapor nozzle for applying a predetermined quantity of vapor-phase hydrogen peroxide to the interior and the exposed exterior of each of the partially formed cartons, the vapor nozzle disposed downline from the bottom forming station and above the conveyor assembly a distance greater than the height of a partially formed carton;

a vaporizer for transforming a solution of hydrogen peroxide and water into a vapor phase hydrogen peroxide, the vaporizer disposed above and in flow communication with the vapor nozzle;

a first hot air distributor capable of flowing hot air into each of the partially formed cartons, the hot air distributor disposed subsequent to the vaporizer;

an ultraviolet radiation chamber for irradiating each of the partially formed cartons with ultraviolet radiation, the ultraviolet radiation chamber having an ingress and an egress and disposed adjacent the vapor nozzle at the ingress, the ultraviolet radiation chamber having an ultraviolet radiation source disposed above the conveyor assembly and a reflector to widely disperse the ultraviolet radiation to provide irradiation of the interior and the exposed exterior of each of the partially formed cartons; and a second hot air distributor capable of flowing hot air into each of the partially formed cartons, the hot air distributor disposed adjacent the egress of the ultraviolet radiation chamber;

whereby each of the partially formed cartons are sterilized by the vapor-phase hydrogen perxoide and the ultraviolet radiation, flushed of any residual hydrogen peroxide by the hot air, and have a residue less than 0.5 parts per million of hydrogen peroxide while having a 4.5 log reduction of microogranisms.

10. The apparatus according to claim 9 wherein each of the partially formed cartons has a fitment attached thereon whereby the exposed portions of the fitment are sterilized with the sterilization of each of the partially formed cartons.

11. The apparatus according to claim 9 wherein the vapor-phase hydrogen peroxide has a concentration lower than 53%.

12. The apparatus according to claim 9 wherein the vapor-phase hydrogen peroxide has a concentration of 35%.

13. The apparatus according to claim 9 wherein the ultraviolet radiation source is an excimer ultraviolet lamp having a substantially monochromatic wavelength.

14. The apparatus according to claim 9 wherein the vapor-phase hydrogen peroxide is applied at a temperature in excess of 175° C.

* * * * *